US010618617B2

(12) United States Patent
Suzuki et al.

(10) Patent No.: US 10,618,617 B2
(45) Date of Patent: Apr. 14, 2020

(54) MARINE PROPULSION UNIT

(71) Applicant: YAMAHA HATSUDOKI KABUSHIKI KAISHA, Iwata-shi, Shizuoka (JP)

(72) Inventors: Takayoshi Suzuki, Shizuoka (JP); Satoshi Ishikawa, Shizuoka (JP); Toshio Suzuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/975,812

(22) Filed: May 10, 2018

(65) Prior Publication Data

US 2018/0257750 A1 Sep. 13, 2018

Related U.S. Application Data

(63) Continuation of application No. PCT/JP2016/083102, filed on Nov. 8, 2016.

(30) Foreign Application Priority Data

Nov. 11, 2005 (JP) ..... 2015-221550

(51) Int. Cl.

| | |
|---|---|
| ***B63H 5/125*** | (2006.01) |
| ***B63H 23/24*** | (2006.01) |
| ***B63H 1/16*** | (2006.01) |
| ***B63H 20/00*** | (2006.01) |
| ***B63H 20/06*** | (2006.01) |

(52) U.S. Cl.

CPC ..... *B63H 5/125* (2013.01); *B63H 1/16* (2013.01); *B63H 20/007* (2013.01); *B63H 20/06* (2013.01); *B63H 23/24* (2013.01); *B63H 2001/165* (2013.01); *B63H 2005/1258* (2013.01)

(58) Field of Classification Search

CPC ..... B63H 2023/005; B63H 2005/1258; B63H 2001/165; B63H 21/17

See application file for complete search history.

(56) References Cited

U.S. PATENT DOCUMENTS

| | | | |
|---|---|---|---|
| 5,306,183 | A | 4/1994 | Holt et al. |
| 2003/0186601 | A1 | 10/2003 | Collier et al. |

(Continued)

FOREIGN PATENT DOCUMENTS

| | | | |
|---|---|---|---|
| EP | 2 591 995 | B1 | 7/2014 |
| JP | 09-164998 | A | 6/1997 |

(Continued)

OTHER PUBLICATIONS

Official Communication issued in International Patent Application No. PCT/JP2016/083102, dated Jan. 24, 2017.

*Primary Examiner* — Andrew Polay

(74) *Attorney, Agent, or Firm* — Keating and Bennett, LLP

(57) ABSTRACT

A marine propulsion unit includes a duct including a stator, a propeller including a rim including a rotor disposed at a position that faces the stator and a blade provided radially inward of the rim, a steering shaft that supports the duct such that the duct is steerable, a casing provided separately from the steering shaft and that extends along a rotation axis of the propeller, and a motor controller disposed in the casing and configured or programmed to control rotational driving of the propeller.

21 Claims, 7 Drawing Sheets

FIRST PREFERRED EMBODIMENT

(56) References Cited

U.S. PATENT DOCUMENTS

| | | | | |
|---|---|---|---|---|
| 2006/0040573 | A1* | 2/2006 | Kobayashi | B63H 20/00 440/84 |
| 2013/0115832 | A1 | 5/2013 | Suzuki et al. | |
| 2013/0115833 | A1* | 5/2013 | Suzuki | B63H 1/16 440/2 |

FOREIGN PATENT DOCUMENTS

| | | | |
|---|---|---|---|
| JP | 2006-056458 | A | 3/2006 |
| JP | 2013-100013 | A | 5/2013 |
| JP | 2013-100014 | A | 5/2013 |
| WO | 2014/111844 | A1 | 7/2014 |

* cited by examiner

FIG. 1 FIRST PREFERRED EMBODIMENT
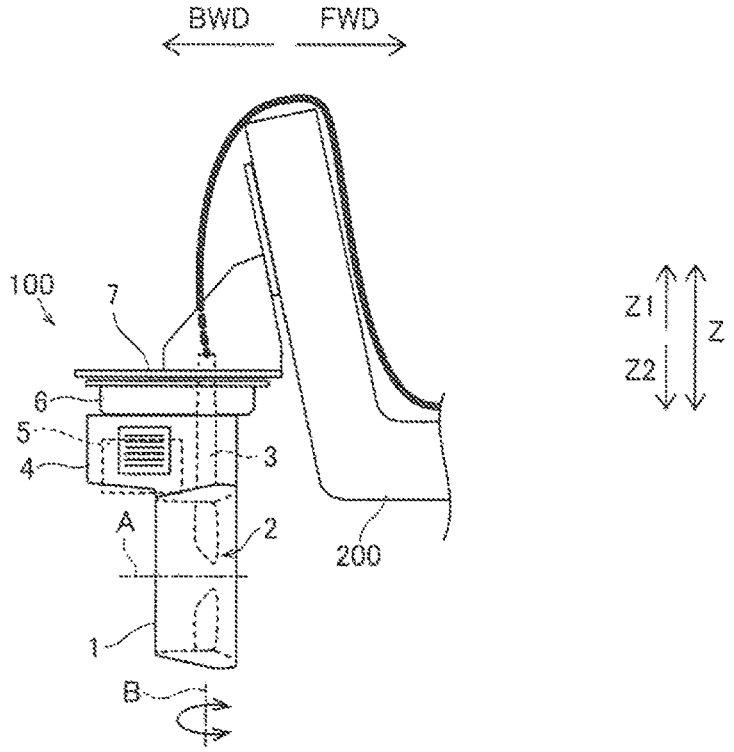
FIG. 2
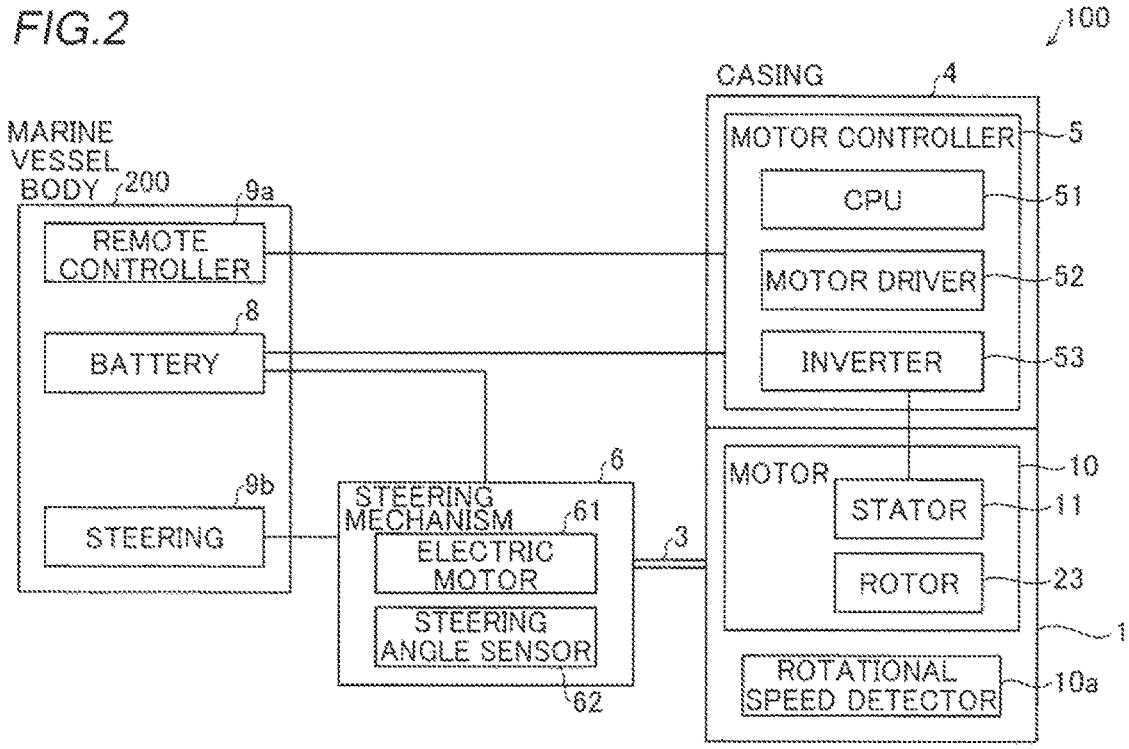

SECOND PREFERRED EMBODIMENT

THIRD PREFERRED EMBODIMENT

MODIFIED EXAMPLE

MARINE PROPULSION UNIT

CROSS REFERENCE TO RELATED APPLICATIONS

This application claims the benefit of priority to Japanese Patent Application No. 2015-221550 filed on Nov. 11, 2015 and is a Continuation Application of PCT Application No. PCT/JP2016/083102 filed on Nov. 8, 2016. The entire contents of each application are hereby incorporated herein by reference.

BACKGROUND OF THE INVENTION

1. Field of the Invention

The present invention relates to a marine propulsion unit.

2. Description of the Related Art

A marine propulsion unit is conventionally known, as disclosed in Japanese Patent Laid-Open No. 2013-100013, for example.

Japanese Patent Laid-Open No. 2013-100013 discloses a marine propulsion unit including a propeller including a duct in which a stator is disposed, a rim in which a rotor is disposed at a position that faces the stator and blades provided radially inward of the rim, a steering shaft that supports the duct such that the duct is steerable, and a motor ECU that controls the rotational driving of the propeller. The motor ECU of the marine propulsion unit is disposed inside the steering shaft or inside a marine vessel.

In the marine propulsion unit disclosed in Japanese Patent Laid-Open No. 2013-100013, when the motor ECU that controls the rotational driving of the propeller is disposed inside the marine vessel, it is necessary to lengthen wiring that connects the motor ECU to a driven portion, and thus the wiring becomes complex. When the motor ECU is disposed inside the steering shaft, the wiring can be shortened, but in the case of a large motor ECU, it is necessary to increase the diameter of the steering shaft in which the motor ECU is disposed. Thus, the size of the entire marine propulsion unit increases. Therefore, a marine propulsion unit capable of significantly reducing or preventing an increase in size while significantly reducing or preventing the complexity of wiring is conventionally desired.

SUMMARY OF THE INVENTION

Preferred embodiments of the present invention provide marine propulsion units that significantly reduce or prevent an increase in size while significantly reducing or preventing the complexity of wiring.

A marine propulsion unit according to a preferred embodiment of the present invention includes a duct including a stator, a propeller including a rim including a rotor disposed at a position that faces the stator and a blade provided radially inward of the rim, a steering shaft that supports the duct such that the duct is steerable, a casing provided separately from the steering shaft and that extends along a rotation axis of the propeller, and a motor controller disposed in the casing and configured or programmed to control rotational driving of the propeller.

In a marine propulsion unit according to a preferred embodiment of the present invention, the motor controller that controls the rotational driving of the propeller is disposed in the casing provided separately from the steering shaft and that extends along the rotation axis of the propeller. Accordingly, the motor controller and a driven portion are disposed close to each other, and thus it is possible to significantly reduce or prevent an increase in the length of wiring that connects the motor controller to the driven portion. Consequently, it is possible to significantly reduce or prevent the complexity of the wiring. Even when the size of the motor controller is increased, the size of the casing is able to be increased along the rotation axis of the propeller such that the motor controller is housed in the casing, and thus it is possible to significantly reduce or prevent an excessive increase in the size of the marine propulsion unit unlike the case where the diameter of the steering shaft is increased. Thus, it is possible to provide the marine propulsion unit that significantly reduces or prevents an increase in size while significantly reducing or preventing the complexity of the wiring. The casing extends along the rotation axis of the propeller such that it is possible to significantly reduce or prevent an increase in water resistance, and thus even when the casing is provided, a marine vessel is able to be propelled without problems. The casing is preferably disposed in the water, and thus it is possible to efficiently cool the motor controller disposed in the casing.

In a marine propulsion unit according to a preferred embodiment of the present invention, the casing is preferably fixed to the duct so as to be steerable together with the duct. With this structure, the duct and the casing are integrally steered, and thus even when the duct is steered, it is possible to significantly reduce or prevent an increase in water resistance due to the casing.

In this case, the casing is preferably integral and unitary with the duct. With this structure, as compared with the case where the duct and the casing are provided separately from each other, it is possible to reduce the number of components and to eliminate a bonded surface between the duct and the casing, and thus it is possible to significantly reduce or prevent water intrusion.

In a marine propulsion unit according to a preferred embodiment of the present invention, the casing is preferably disposed above the duct. With this structure, when the duct is located at a distance below the water surface in order to significantly reduce or prevent entrainment of air from the water surface, the casing effectively utilizes a space between the duct and the water surface.

In a marine propulsion unit according to a preferred embodiment of the present invention, at least a portion of the casing is preferably located rearward of the steering shaft. With this structure, the casing extends rearwards of the steering shaft, and thus when the casing is steered together with the duct, it is possible to significantly reduce or prevent interference of the casing with a marine vessel body on which the marine propulsion unit is mounted.

In a marine propulsion unit according to a preferred embodiment of the present invention, at least a portion of the casing preferably extends rearward of a rear end of the duct. With this structure, even when the size of the motor controller is increased, the casing extends rearward of the rear end of the duct such that the size of the casing is increased, and thus the motor controller is easily housed in the casing.

In this case, the casing is preferably fixed to the duct behind the duct on the rotation axis of the propeller. With this structure, water flow discharged from the duct is rectified by the casing, and thus the marine vessel is more efficiently propelled.

In a marine propulsion unit according to a preferred embodiment of the present invention, the casing preferably defines and functions as a skeg. With this structure, it is possible to improve the steering performance of the marine vessel using the casing in which the motor controller is disposed.

In a marine propulsion unit according to a preferred embodiment of the present invention, in a planar view, a length of the casing in a direction parallel or substantially parallel to the rotation axis of the propeller is preferably larger than a length of the casing in a direction perpendicular or substantially perpendicular to the rotation axis of the propeller. With this structure, it is possible to significantly reduce or prevent an increase in the projected area when the casing is viewed along the rotation axis of the propeller, and thus it is possible to significantly reduce or prevent an increase in water resistance.

In a marine propulsion unit according to a preferred embodiment of the present invention, a heat radiator exposed to the outside of the casing is preferably provided adjacent a region of the casing in which the motor controller is disposed. With this structure, the heat of the motor controller is easily discharged to the outside of the casing (into the water) via the heat radiator, and thus the motor controller is effectively cooled.

In a marine propulsion unit according to a preferred embodiment of the present invention, the motor controller is preferably provided on a substrate that extends parallel or substantially parallel to the rotation axis of the propeller, and the casing is preferably elongated so as to extend in a direction in which the substrate extends. With this structure, the substrate on which the motor controller is provided is easily housed in the elongated casing.

In a marine propulsion unit according to a preferred embodiment of the present invention, the casing is preferably streamlined along the rotation axis of the propeller. With this structure, the water resistance in the casing is effectively reduced, and thus even when the casing is provided, the marine vessel is efficiently propelled.

In a marine propulsion unit according to a preferred embodiment of the present invention, the motor controller preferably includes at least one of a motor driver and an inverter. With this structure, at least one of the motor driver and the inverter is preferably housed in the casing located in the water, and thus the motor driver and the inverter are effectively cooled.

In a marine propulsion unit according to a preferred embodiment of the present invention, a sectional shape of the duct preferably varies along the rotation axis of the propeller. With this structure, a fluid that flows through the duct is rectified, and thus a propulsive force is efficiently generated.

In a marine propulsion unit according to a preferred embodiment of the present invention, the blade preferably includes at least three and not more than eight blades. With this structure, the at least three and not more than eight blades are disposed in a balanced manner radially inward of the rim, and thus the marine propulsion unit is efficiently operated.

A marine propulsion unit according to a preferred embodiment of the present invention preferably further includes a steering mechanism disposed above the duct and that steers the duct, and the casing is preferably disposed between the duct and the steering mechanism. With this structure, the duct is easily steered by the steering mechanism. When the duct is located at a distance below the water surface in order to significantly reduce or prevent entrainment of air from the water surface, the casing effectively utilizes a space between the duct and the steering mechanism.

In this case, the steering mechanism is preferably streamlined in a forward-backward movement direction. With this structure, the water resistance in the steering mechanism is effectively reduced, and thus the marine vessel is more efficiently propelled.

In a preferred embodiment of a structure including a steering mechanism, the steering mechanism preferably includes an electric motor, and rotates the steering shaft by driving the electric motor. With this structure, the electric motor is driven such that the duct is easily steered.

In a preferred embodiment of a structure including a steering mechanism, an upper surface of the steering mechanism is preferably fixed to a bracket mounted on a marine vessel body. With this structure, the steering mechanism is reliably mounted on the marine vessel body.

In this case, the bracket preferably includes a marine vessel body mount and a propulsion unit mount. With this structure, it is possible to fix the marine vessel body mount to the marine vessel body and to fix the marine propulsion unit to the propulsion unit mount, and thus the marine propulsion unit is reliably mounted on the marine vessel body.

A marine propulsion unit according to a preferred embodiment of the present invention preferably further includes a duct connector connected to an upper portion of the duct and that surrounds the steering shaft, and the duct connector preferably includes a housing including an internal space in which the steering shaft is disposed, a collar disposed in the internal space between the housing and the steering shaft at an upper end of the housing, and a through-hole provided below the collar and that communicates between the internal space in which the steering shaft is disposed and an outside of the duct connector. With this structure, the collar significantly reduces or prevents entry of foreign matter into the duct connector from the upper surface. Even when foreign matter enters the duct connector, the foreign matter is able to be discharged from the through-hole provided there below. Thus, it is possible to significantly reduce or prevent accumulation of foreign matter in the duct connector.

In this case, a radial length of a gap of an inner periphery or an outer periphery of the collar is preferably smaller than an inner diameter of the through-hole. With this structure, even when foreign matter enters from the gap of the inner periphery or the outer periphery of the collar, the foreign matter is easily discharged from the through-hole having an inner diameter larger than that of the gap.

According to various preferred embodiments of the present invention, as described above, it is possible to significantly reduce or prevent an increase in the size of a marine propulsion unit while significantly reducing or preventing the complexity of the wiring.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 1 is a diagram showing a marine vessel including a marine propulsion unit according to a first preferred embodiment of the present invention.

FIG. 2 is a block diagram showing the control structure of the marine propulsion unit according to the first preferred embodiment of the present invention.

DETAILED DESCRIPTION OF THE PREFERRED EMBODIMENTS

Preferred embodiments of the present invention are hereinafter described on the basis of the drawings.

First Preferred Embodiment

The structure of a marine propulsion unit 100 according to a first preferred embodiment of the present invention is described with reference to FIGS. 1 to 8. In the figures, arrow FWD represents the forward movement direction of a marine vessel, and arrow BWD represents the backward movement direction of the marine vessel. In the figures, arrow R represents the starboard direction of the marine vessel, and arrow L represents the portside direction of the marine vessel.

Figure 4:
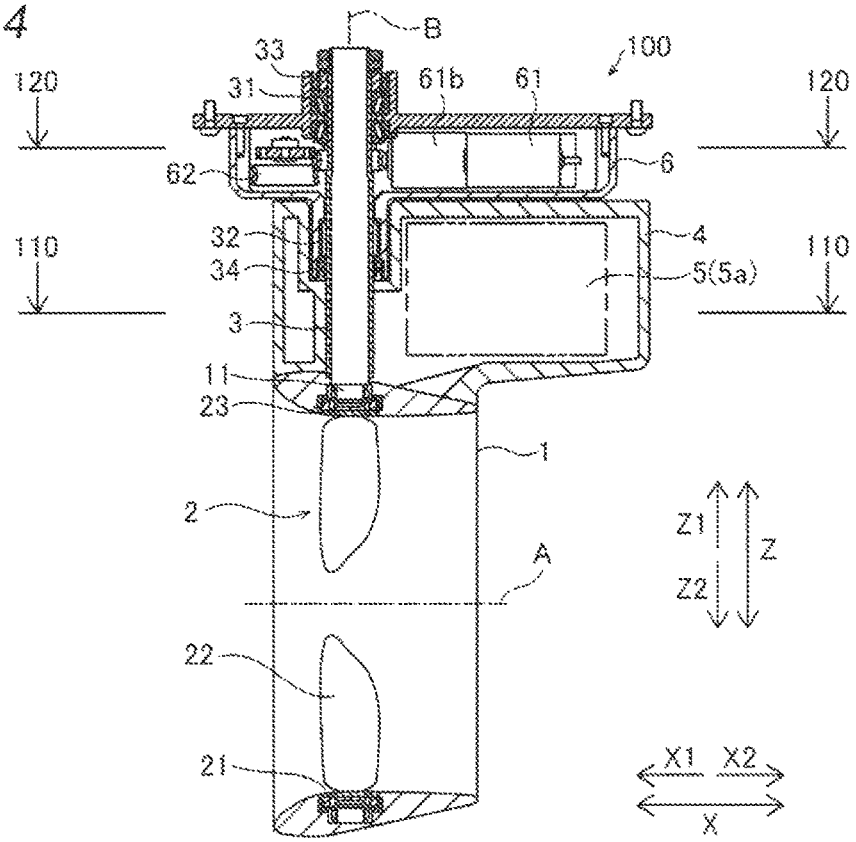
FIG. 4 is a side sectional view of the marine propulsion unit according to the first preferred embodiment of the present invention.

As shown in FIG. 1, the marine propulsion unit 100 includes an electric thruster that propels a marine vessel body 200. The marine propulsion unit 100 includes a tubular duct 1, a propeller 2, a steering shaft 3, a casing 4, a motor controller 5, and a steering mechanism 6. As shown in FIGS. 2 and 4, the duct 1 includes a stator 11. As shown in FIG. 4, the propeller 2 includes a rim 21 and a plurality of blades 22. The rim 21 includes a rotor 23. As shown in FIG. 2, a motor 10 (for example, a switched reluctance motor) includes the stator 11 and the rotor 23.

Figure 6:
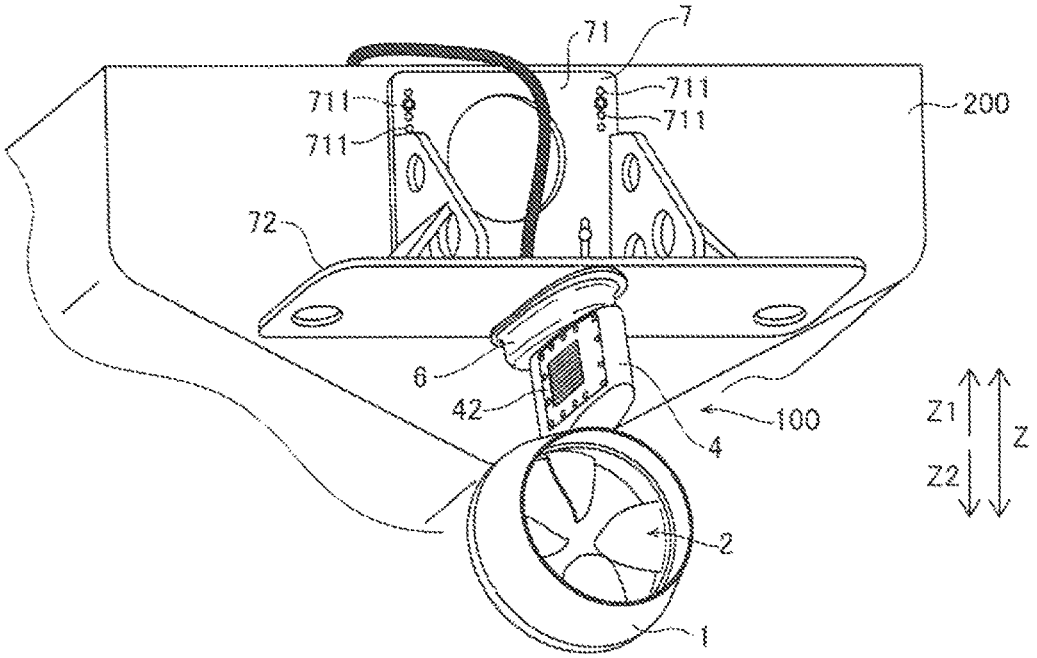
FIG. 6 is a perspective view showing the marine propulsion unit and a bracket according to the first preferred embodiment of the present invention.

As shown in FIGS. 1 and 6, the marine propulsion unit 100 is mounted on the marine vessel body 200 via a bracket 7. As shown in FIG. 2, the marine vessel body 200 includes a battery 8, a remote controller 9*a*, and a steering wheel 9*b*. The marine propulsion unit 100 (motor 10) is connected to the motor controller 5. The battery 8 and the remote controller 9*a* are connected to the motor controller 5. The motor controller 5 includes a CPU (central processing unit) 51, a motor driver 52, and an inverter 53.

As shown in FIG. 1, the marine propulsion unit 100 (duct 1) is rotatable about a steering axis B that intersects with the rotation axis A of the propeller 2. The marine propulsion unit 100 is steered (rotated) by the steering mechanism 6. As shown in FIG. 2, the steering mechanism 6 includes an electric motor 61 and a steering angle sensor 62. The steering mechanism 6 steers the duct 1 and the casing 4 by rotating the steering shaft 3. The steering mechanism 6 is connected to the battery 8 and the steering wheel 9*b*.

As shown in FIG. 2, the remote controller 9*a* is operated such that the magnitude of the propulsive force of the marine propulsion unit 100 is adjusted. The steering wheel 9*b* is operated such that the direction (the orientation of the duct 1) of the propulsive force of the marine propulsion unit 100 is adjusted. In other words, the steering wheel 9*b* is manipulated such that the orientation of the marine propulsion unit 100 is changed, and the marine vessel body 200 is steered.

Figure 3:
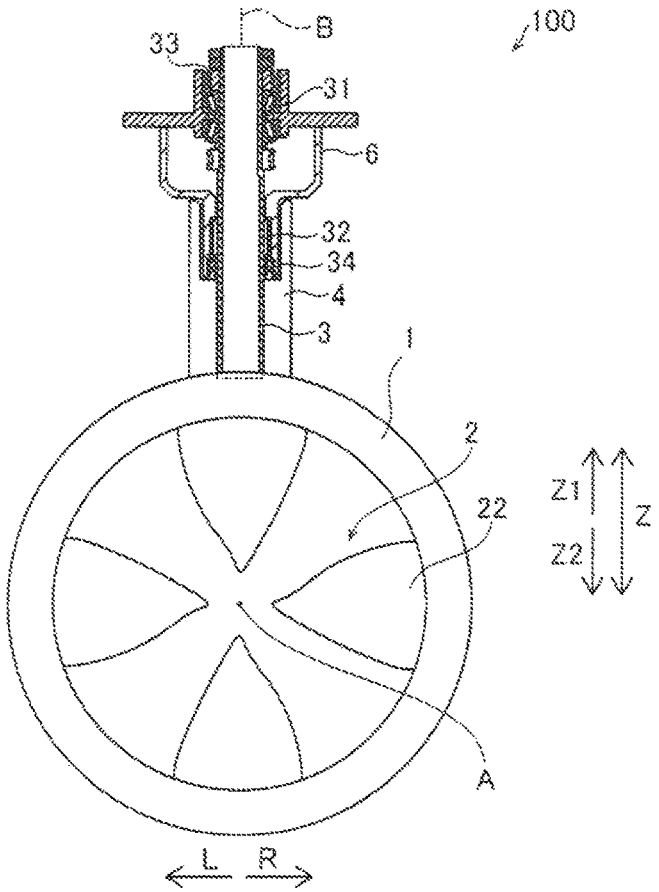
FIG. 3 is a rear view of the marine propulsion unit according to the first preferred embodiment of the present invention.

As shown in FIGS. 3 and 4, the duct 1 is preferably tubular. The sectional shape of the duct 1 varies along the rotation axis A of the propeller 2. In other words, a portion of the duct 1 in a direction X1 expands outward, and a portion of the duct 1 in a direction X2 gradually narrows. A circumferential recess recessed radially outward from the inner surface thereof is provided in the duct 1. The propeller 2 is accommodated in the recess. Specifically, the propeller 2 is rotatably supported by the duct 1 via a fluid bearing provided along the recess of the duct 1.

The stator 11 is disposed on the outer periphery of the recess of the duct 1. The stator 11 includes windings. In the stator 11, electric power is supplied to the windings such that a magnetic field is generated. A plurality of windings are disposed circumferentially along the recess of the tubular duct 1. Electric power is supplied to the plurality of windings in synchronization with the number of rotations. Thus, the magnetic force of the stator 11 acts on the rotor 23 of the propeller 2, and the propeller 2 is rotated.

The propeller 2 is rotatably disposed radially inward of the tubular duct 1. The rim 21 of the propeller 2 preferably has a tubular shape outward of the blades 22. The blades 22 are provided radially inward of the rim 21 from the inner surface of the rim 21. As shown in FIG. 3, four blades 22, for example, are provided at equal intervals or substantially equal intervals (e.g., about every 90 degrees) in the circumferential direction. The blades 22 are preferably wing-shaped.

The rotor 23 is provided outward of the rim 21. The rotor 23 is disposed at a position that faces the stator 11 of the duct 1. Specifically, the rotor 23 and the stator 11 face each other at a predetermined interval in a radial direction. That is, the motor 10 including the stator 11 and the rotor 23 is a radial gap motor. In the rotor 23, a portion having a high magnetic permeability and a portion having a low magnetic permeability are alternately and circumferentially disposed. That is, a reluctance torque is generated in the rotor 23 due to the magnetic force generated from the stator 11. Thus, the rotor 23 (rim 21) rotates.

As shown in FIGS. 3 and 4, the steering shaft 3 supports the duct 1 such that the duct 1 is steerable. Specifically, the steering shaft 3 is rotatably supported by the steering mechanism 6 via a tapered roller bearing 31. The steering shaft 3 supports the casing 4 integral and unitary with the duct 1 via a cylindrical roller bearing 32. The steering shaft 3 is hollow. In the interior of the hollow steering shaft 3, wiring through which electric power is supplied to the stator 11, wiring that connects the motor controller 5 to the battery 8, wiring that connects the remote controller 9*a* to the motor controller 5, and wiring that connects the steering wheel 9*b* to the steering mechanism 6 are housed.

The steering shaft 3 includes seals 33 and 34 to prevent water intrusion into the casing 4, the steering mechanism 6, and the stator 11. Specifically, the seal 33 is provided between the steering shaft 3 and the steering mechanism 6. The seal 34 is provided between the steering shaft 3 and the casing 4.

According to the first preferred embodiment, the casing 4 is provided separately from the steering shaft 3, and extends along the rotation axis A of the propeller 2. The motor controller 5 is disposed in the casing 4. The casing 4 is fixed to the duct 1 so as to be steerable together with the duct 1. Specifically, the casing 4 is integral and unitary with the duct 1.

The casing 4 is disposed above the duct 1. Specifically, the casing 4 is disposed between the duct 1 and the steering mechanism 6. At least a portion of the casing 4 is located rearward of the steering shaft 3. At least a portion of the casing 4 extends rearward of the rear end of the duct 1. Specifically, in a planar view, the length of the casing 4 in a direction parallel or substantially parallel to the rotation axis A of the propeller 2 is larger than the length of the casing 4 in a direction perpendicular or substantially perpendicular to the rotation axis A of the propeller 2. That is, the casing 4 extends along a plane parallel or substantially parallel to the rotation axis A of the propeller 2 and parallel or substantially parallel to an upward-downward direction. The casing 4 defines and functions as a skeg. In other words, the casing 4 also defines and acts as a fin that stabilizes the traveling performance of the marine vessel body 200.

Figure 7:
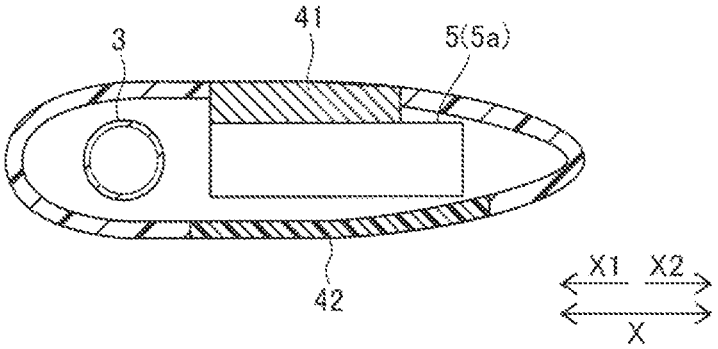
FIG. 7 is a sectional view taken along the line 110-110 in FIG. 4.

As shown in FIG. 7, the casing 4 is streamlined along the rotation axis A of the propeller 2. Specifically, the casing 4 is streamlined such that the resistance to water that flows relative to a direction X is small.

As shown in FIG. 7, the casing 4 includes a heat radiator 41 and a lid 42. The heat radiator 41 is disposed adjacent to a region of the casing 4 in which the motor controller 5 is disposed while being exposed to the outside of the casing 4. The heat radiator 41 radiates the heat of the motor controller 5 to the outside of the casing 4. The heat radiator 41 is preferably made of a metal material such as aluminum. A plurality of fins that extend in the direction X are provided on the outer surface of the heat radiator 41. Thus, the surface area is increased, and thus it is possible to efficiently radiate the heat. The heat radiator 41 is preferably provided on one side of the casing 4 in a right-left direction. The lid 42 is preferably provided on the other side of the casing 4 in the right-left direction.

The lid 42 is provided to allow the motor controller 5 to be taken in and out of the casing 4. The lid 42 covers the motor controller 5. The heat radiator 41 and the lid 42 are mounted on the casing 4 via a seal. That is, the casing 4 is hermetically sealed in a state where the heat radiator 41 and the lid 42 are mounted.

The motor controller 5 is configured or programmed to control the rotational driving of the propeller 2 (motor 10). Specifically, the motor controller 5 controls the rotational speed of the motor 10 based on the operation of the remote controller 9*a*. The CPU 51 receives a signal from a rotational speed detector 10*a* provided in the motor 10. The CPU 51 supplies electric power to the motor 10 (stator 11) via the motor driver 52 and the inverter 53.

Figure 5:
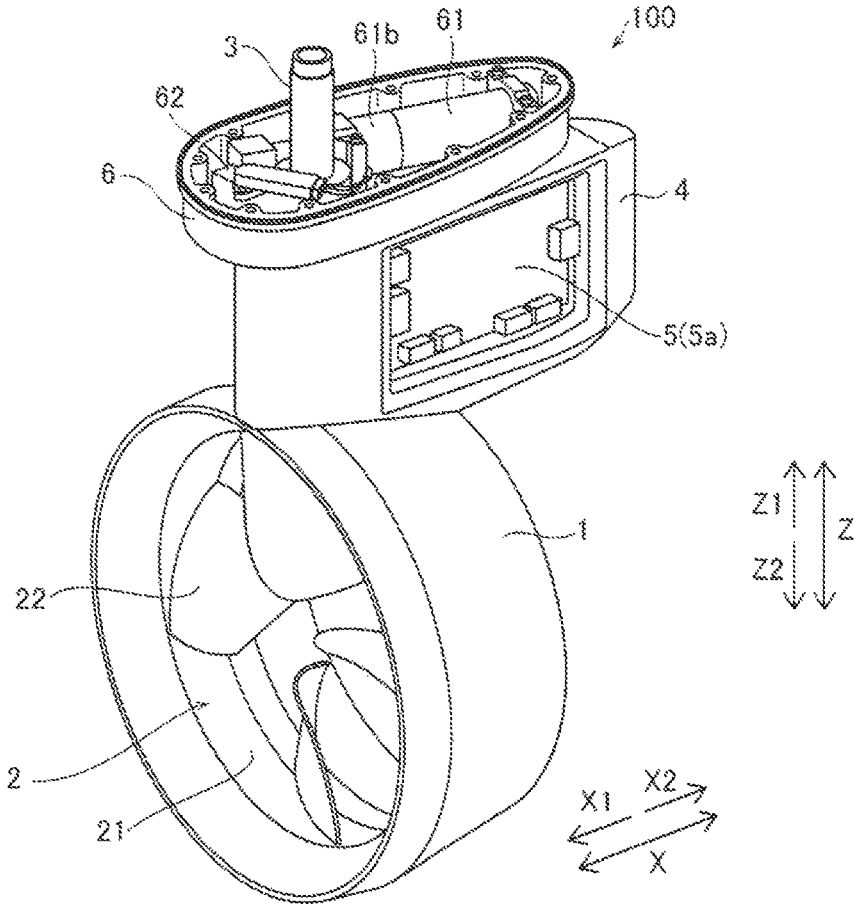
FIG. 5 is a perspective view showing the marine propulsion unit according to the first preferred embodiment of the present invention

The motor controller 5 (the CPU 51, the motor driver 52, and the inverter 53) is preferably provided on a substrate 5*a*. As shown in FIG. 5, the substrate 5*a* preferably has a flat plate shape. The substrate 5*a* extends parallel or substantially parallel to the rotation axis A of the propeller 2. In other words, the substrate 5*a* is disposed in the casing 4 and elongated so as to extend in a direction in which the substrate 5*a* extends. As shown in FIG. 7, the substrate 5*a* is disposed in contact with the heat radiator 41. Thus, it is possible to effectively transfer heat generated by the CPU 51, the motor driver 52, the inverter 53, etc. to the heat radiator 41.

Figure 8:
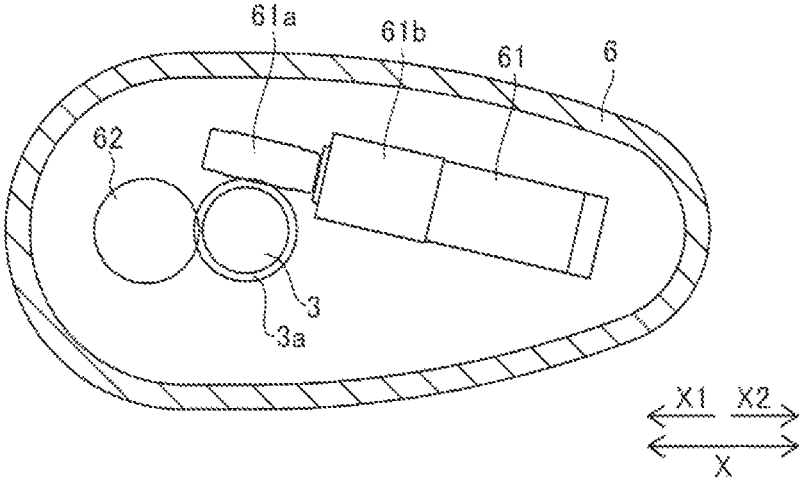
FIG. 8 is a sectional view taken along the line 120-120 in FIG. 4.

As shown in FIGS. 3 to 5, the steering mechanism 6 is disposed above the duct 1, and steers the duct 1. The electric motor 61 of the steering mechanism 6 is driven based on the operation of the steering wheel 9*b* (see FIG. 2). Electric power is supplied from the battery 8 to the electric motor 61 via a driver, and the electric motor 61 is rotationally driven. As shown in FIG. 8, the electric motor 61 rotates the steering shaft 3 via a worm gear 61*a* and a gear 3*a*. A speed reducer 61*b* is provided between the electric motor 61 and the worm gear 61*a*. The speed reducer 61*b* preferably includes a planetary gear. The steering angle sensor 62 detects the rotation angle of the steering shaft 3. The detected rotation angle of the steering shaft 3 is feedback-controlled, and the electric motor 61 is driven.

The outer surface of the steering mechanism 6 is streamlined in a forward-backward movement direction. As shown in FIGS. 1 and 6, the upper surface (the surface in a direction Z1) of the steering mechanism 6 is fixed to the bracket 7 mounted on the marine vessel body 200.

As shown in FIG. 6, the bracket 7 supports the marine propulsion unit 100, and is mounted on the rear of the marine vessel body 200. The bracket 7 includes a marine vessel body mount 71 and a propulsion unit mount 72. The marine vessel body mount 71 preferably has a flat plate shape. The marine vessel body mount 71 is mounted on a transom on the rear of the marine vessel body 200. The propulsion unit mount 72 is mounted on the marine vessel body mount 71 at a predetermined angle. The propulsion unit mount 72 preferably has a flat plate shape extending in a horizontal or substantially horizontal direction. The marine propulsion unit 100 is mounted on the propulsion unit mount 72. A plurality of marine propulsion units 100 are able to be mounted on the propulsion unit mount 72. Specifically, the propulsion unit mount 72 includes a plurality of holes 711 (insertion holes for bolts or the like) used to mount the marine propulsion unit 100. The marine vessel body mount 71 includes a plurality of holes 711 corresponding to a bracket used to mount an outboard motor including an engine. The holes 711 of the marine vessel body mount 71 are disposed in rows at an interval of about 12.8 inches (about 327 mm), for example, in the right-left direction, similarly to the bracket of the outboard motor, for example. Thus, it is possible to easily mount the marine propulsion unit 100 on the marine vessel body 200 instead of the outboard motor.

According to the first preferred embodiment described above, the following advantageous effects are achieved.

According to the first preferred embodiment described above, the motor controller 5 that controls the rotational driving of the propeller 2 is disposed in the casing 4 provided separately from the steering shaft 3 and that extends along the rotation axis A of the propeller 2. Accordingly, the motor controller 5 and the motor 10 are disposed close to each other, and thus it is possible to significantly reduce or prevent an increase in the length of wiring that connects the motor controller 5 to the motor 10. Consequently, it is possible to significantly reduce or prevent the complexity of the wiring. Even when the size of the motor controller 5 is increased, the size of the casing 4 is able to be increased along the rotation axis A of the propeller 2 such that the motor controller 5 is able to be housed in the casing 4, and thus it is possible to significantly reduce or prevent an excessive increase in the size of the marine propulsion unit 100, unlike the case in which the diameter of the steering shaft 3 is increased. Thus, it is possible to significantly reduce or prevent an increase in size of the marine propulsion unit 100 while significantly reducing or preventing the complexity of the wiring. The casing 4 extends along the rotation axis A of the propeller 2 such that it is possible to significantly reduce or prevent an increase in water resistance, and thus even when the casing 4 is provided, the marine vessel is able to be propelled without problems. The casing 4 is preferably disposed in the water, and thus it is possible to efficiently cool the motor controller 5 disposed in the casing 4.

According to the first preferred embodiment described above, the casing 4 is fixed to the duct 1 so as to be steerable together with the duct 1. Accordingly, the duct 1 and the casing 4 are integrally steered, and thus even when the duct 1 is steered, it is possible to significantly reduce or prevent an increase in water resistance due to the casing 4.

According to the first preferred embodiment described above, the casing 4 is preferably integral and unitary with the duct 1. Accordingly, as compared with the case in which the duct 1 and the casing 4 are provided separately from each other, it is possible to reduce the number of components and to eliminate a bonded surface between the duct 1 and the casing 4, and thus it is possible to significantly reduce or prevent water intrusion.

According to the first preferred embodiment described above, the casing 4 is disposed above the duct 1. Accordingly, when the duct 1 is located at a distance below the water surface in order to significantly reduce or prevent entrainment of air from the water surface, the casing 4 effectively utilizes a space between the duct 1 and the water surface.

According to the first preferred embodiment described above, at least a portion of the casing 4 is located rearward of the steering shaft 3. Accordingly, the casing 4 extends rearward of the steering shaft 3, and thus when the casing 4 is steered together with the duct 1, it is possible to significantly reduce or prevent interference of the casing 4 with the marine vessel body 200 on which the marine propulsion unit 100 is mounted.

According to the first preferred embodiment described above, at least a portion of the casing 4 extends rearward of the rear end of the duct 1. Accordingly, even when the size of the motor controller 5 is increased, the casing 4 extends rearward of the rear end of the duct 1 such that the size of the casing 4 is able to be increased, and thus the motor controller 5 is easily housed in the casing 4.

According to the first preferred embodiment described above, the casing 4 defines and functions as a skeg.

Accordingly, it is possible to improve the steering performance of the marine vessel using the casing 4 in which the motor controller 5 is disposed.

According to the first preferred embodiment described above, in the planar view, the length of the casing 4 in the direction parallel or substantially parallel to the rotation axis A of the propeller 2 is larger than the length of the casing 4 in the direction perpendicular or substantially perpendicular to the rotation axis A of the propeller 2. Accordingly, it is possible to significantly reduce or prevent an increase in the projected area when the casing 4 is viewed along the rotation axis A of the propeller 2, and thus it is possible to significantly reduce or prevent an increase in water resistance.

According to the first preferred embodiment described above, the heat radiator 41 is exposed to the outside of the casing 4 adjacent the region of the casing 4 in which the motor controller 5 is disposed. Accordingly, the heat of the motor controller 5 is easily discharged to the outside of the casing 4, and into the water, via the heat radiator 41, and thus the motor controller 5 is effectively cooled.

According to the first preferred embodiment described above, the motor controller 5 is provided on the substrate 5*a* that extends parallel or substantially parallel to the rotation axis A of the propeller 2, and the casing 4 is elongated so as to extend in the direction in which the substrate 5*a* extends. Accordingly, the substrate 5*a* on which the motor controller 5 is provided is easily housed in the elongated casing 4.

According to the first preferred embodiment described above, the casing 4 is streamlined along the rotation axis A of the propeller 2. Accordingly, the water resistance in the casing 4 is effectively reduced, and thus even when the casing 4 is provided, the marine vessel is efficiently propelled.

According to the first preferred embodiment described above, the motor controller 5 includes the motor driver 52 and the inverter 53. Accordingly, the motor driver 52 and the inverter 53 are housed in the casing 4 located in the water, and thus the motor driver 52 and the inverter 53 are effectively cooled.

According to the first preferred embodiment described above, the sectional shape of the duct 1 varies along the rotation axis A of the propeller 2. Accordingly, a fluid that flows through the duct 1 is rectified, and thus a propulsive force is efficiently generated.

According to the first preferred embodiment described above, the marine propulsion unit 100 preferably includes at least three and not more than eight blades 22. Accordingly, the at least three and not more than eight blades 22 are able to be disposed in a balanced manner radially inward of the rim 21, and thus the marine propulsion unit 100 is efficiently operated.

According to the first preferred embodiment described above, the steering mechanism 6 is disposed above the duct 1 and steers the duct 1, and the casing 4 is disposed between the duct 1 and the steering mechanism 6. Accordingly, the duct 1 is easily steered by the steering mechanism 6. When the duct 1 is located at a distance below the water surface in order to significantly reduce or prevent entrainment of air from the water surface, the casing 4 effectively utilizes a space between the duct 1 and the steering mechanism 6.

According to the first preferred embodiment described above, the steering mechanism 6 is streamlined in the forward-backward movement direction. Accordingly, the water resistance in the steering mechanism 6 is effectively reduced, and thus the marine vessel is more efficiently propelled.

According to the first preferred embodiment described above, the steering mechanism 6 rotates the steering shaft 3 by driving the electric motor 61. Accordingly, the electric motor 61 is driven such that the duct 1 is easily steered.

According to the first preferred embodiment described above, the upper surface of the steering mechanism 6 is preferably fixed to the bracket 7 mounted on the marine vessel body 200. Accordingly, the steering mechanism 6 is reliably mounted on the marine vessel body 200.

According to the first preferred embodiment described above, the bracket 7 includes the marine vessel body mount 71 and the propulsion unit mount 72. Accordingly, it is possible to fix the marine vessel body mount 71 to the marine vessel body 200 and to fix the marine propulsion unit 100 to the propulsion unit mount 72, and thus the marine propulsion unit 100 is reliably mounted on the marine vessel body 200.

Second Preferred Embodiment

Figure 9:
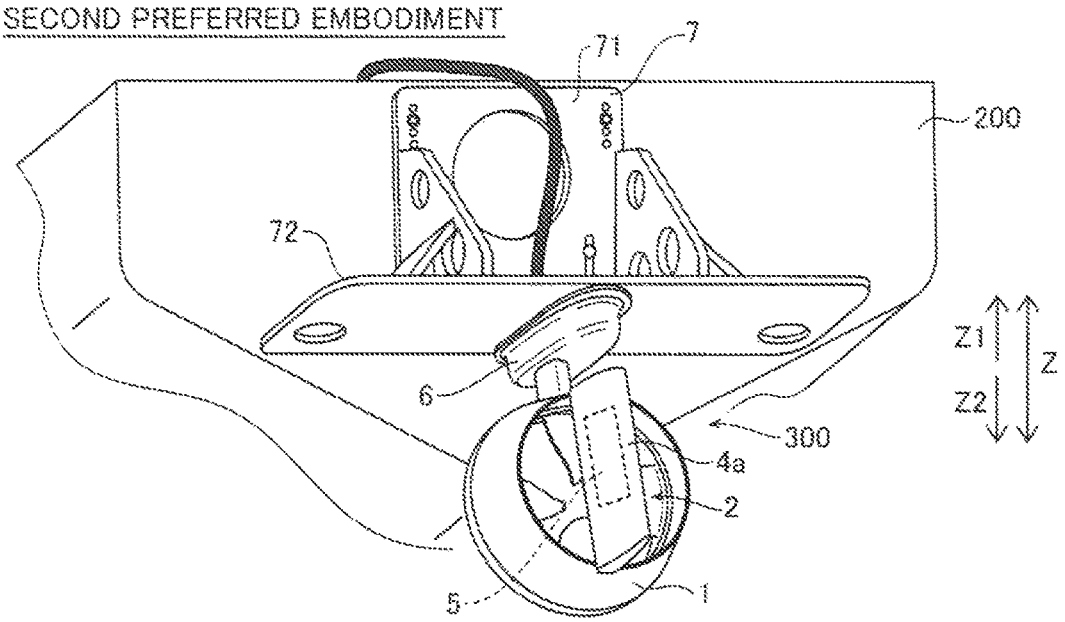
FIG. 9 is a perspective view showing a marine propulsion unit and a bracket according to a second preferred embodiment of the present invention.

A second preferred embodiment of the present invention is now described with reference to FIG. 9. In the second preferred embodiment, an example in which a casing is disposed behind a duct is described unlike the first preferred embodiment in which the casing is disposed above the duct. The same structures as those of the first preferred embodiment are denoted by the same reference numerals.

A marine propulsion unit 300 includes a tubular duct 1, a propeller 2, a steering shaft 3, a casing 4*a*, a motor controller 5, and a steering mechanism 6.

According to the second preferred embodiment, the casing 4*a* is provided separately from the steering shaft 3, and extends along the rotation axis A of the propeller 2. The motor controller 5 is disposed in the casing 4*a*. At least a portion of the casing 4*a* extends rearward of the rear end of the duct 1. The casing 4*a* is fixed to the duct 1 behind the duct 1 on the rotation axis A of the propeller 2. Specifically, the casing 4*a* extends in an upward-downward direction (direction Z) behind the duct 1.

The remaining structures of the second preferred embodiment are similar to those of the first preferred embodiment described above.

According to the second preferred embodiment, the following advantageous effects are achieved.

According to the second preferred embodiment, similarly to the first preferred embodiment described above, the motor controller 5 that controls the rotational driving of the propeller 2 is disposed in the casing 4*a* that is provided separately from the steering shaft 3 and that extends along the rotation axis A of the propeller 2. Accordingly, it is possible to significantly reduce or prevent an increase in the size of the marine propulsion unit while significantly reducing or preventing the complexity of wiring.

According to the second preferred embodiment described above, the casing 4*a* is fixed to the duct 1 behind the duct 1 on the rotation axis A of the propeller 2. Accordingly, water flow discharged from the duct 1 is rectified by the casing 4*a*, and thus a marine vessel is more efficiently propelled.

The remaining advantageous effects of the second preferred embodiment are similar to those of the first preferred embodiment described above.

Third Preferred Embodiment

A third preferred embodiment of the present invention is now described with reference to FIGS. 10 to 13. In the third preferred embodiment, an example in which a collar is provided at a duct connector that surrounds a steering shaft is described. The same structures as those of the first preferred embodiment are denoted by the same reference numerals.

Figure 10:
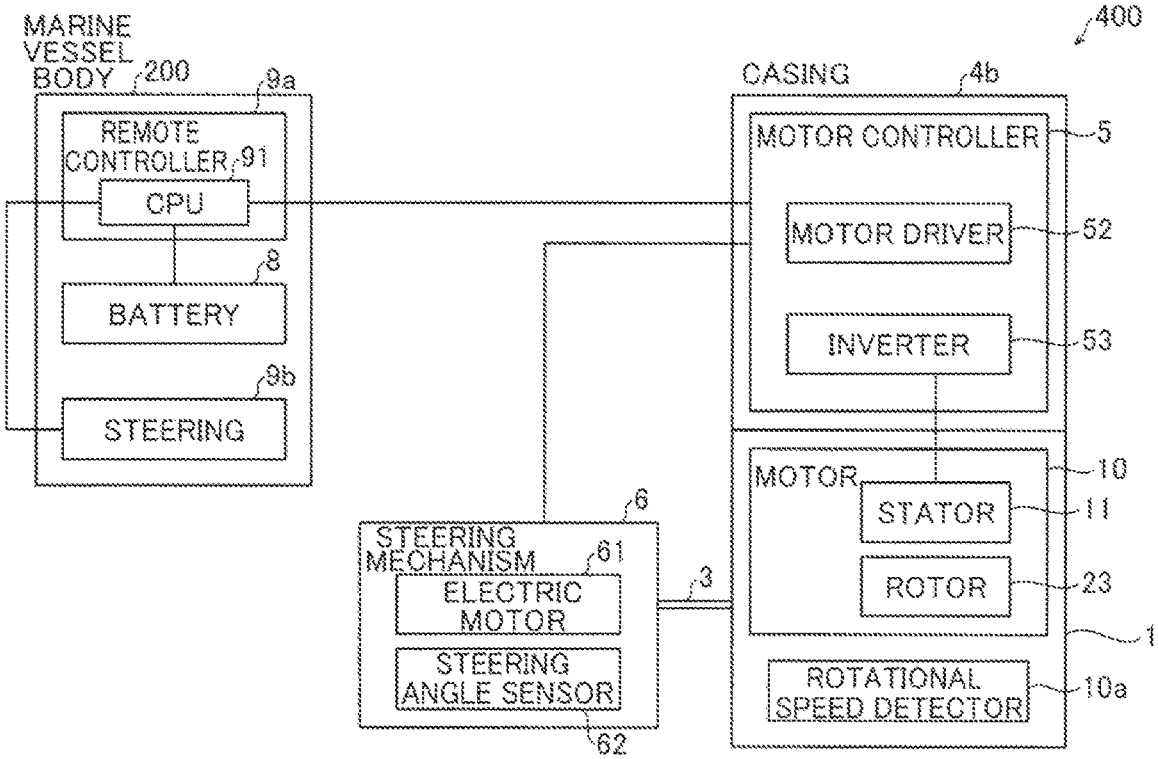
FIG. 10 is a block diagram showing the control structure of a marine propulsion unit according to a third preferred embodiment of the present invention.

As shown in FIG. 10, a marine propulsion unit 400 includes a tubular duct 1, a propeller 2 (see FIG. 11), a steering shaft 3, a casing 4*b*, a motor controller 5, and a steering mechanism 6.

According to the third preferred embodiment, as shown in FIG. 10, a remote controller 9*a* provided on a marine vessel body 200 includes a CPU 91. The CPU 91 is connected to the motor controller 5. The CPU 91 controls the rotational driving of the propeller 2 (motor 10) via the motor controller 5. Specifically, the CPU 91 controls the rotational speed of the motor 10 based on the operation of the remote controller 9*a*. The CPU 91 receives a signal from a rotational speed detector 10*a* provided in the motor 10. The CPU 91 supplies electric power to the motor (stator 11) via the motor controller 5 (a motor driver 52 and an inverter 53).

The CPU 91 controls the steering mechanism 6 based on the operation of a steering wheel 9*b*. The CPU 91 supplies electric power to the steering mechanism 6 via the motor controller 5. That is, the CPU 91 controls the steering mechanism 6 to steer the duct 1 via the motor controller 5 based on the operation of the steering wheel 9*b*. Thus, the CPU 91 provided in the marine vessel body 200 efficiently controls the marine vessel maneuvering operation.

Figure 11:
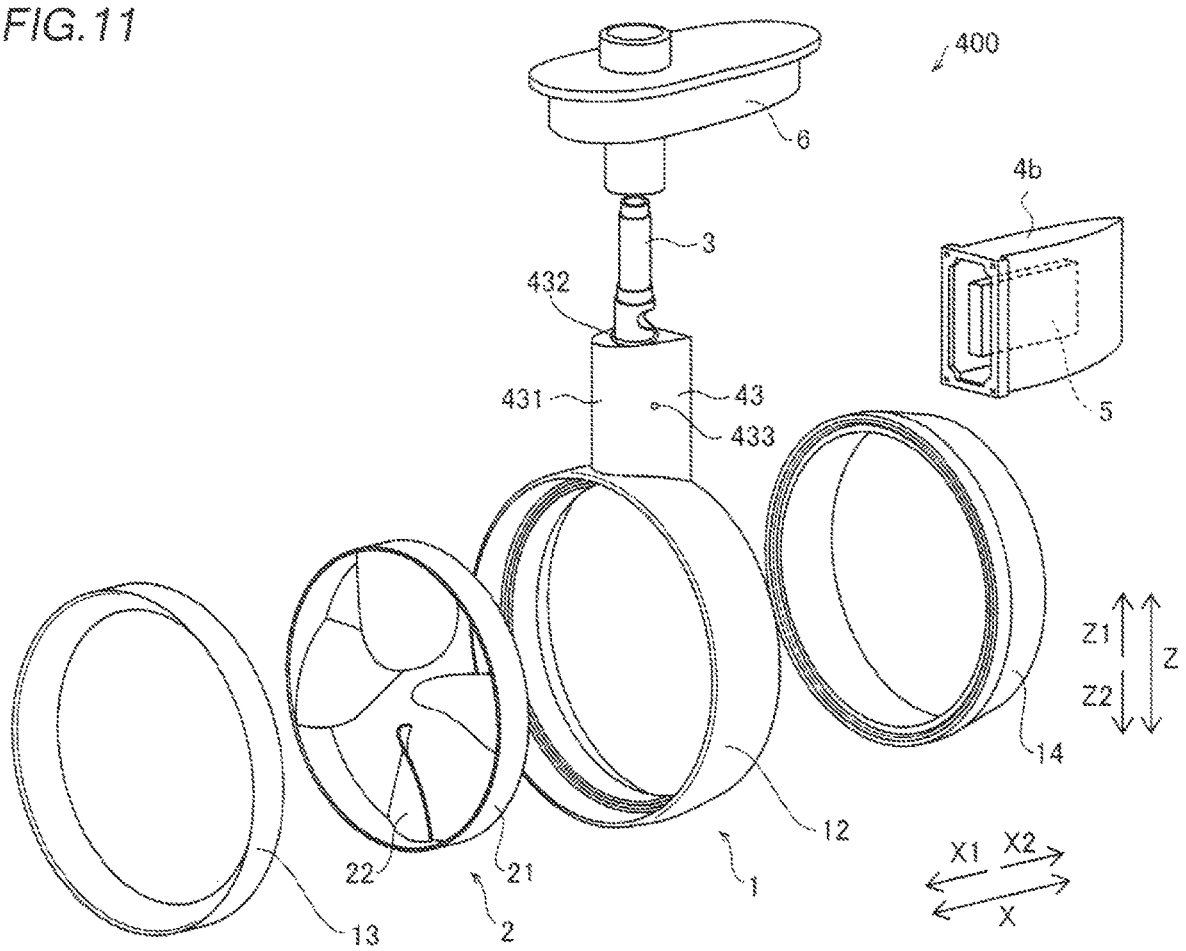
FIG. 11 is an exploded perspective view showing the marine propulsion unit according to the third preferred embodiment of the present invention.

According to the third preferred embodiment, the casing 4*b* is provided separately from the steering shaft 3, and extends along the rotation axis A (see FIG. 1) of the propeller 2. The motor controller 5 is disposed in the casing 4*b*. The casing 4*b* is fixed to the duct 1 so as to be steerable together with the duct 1. Specifically, as shown in FIG. 11, the casing 4*b* is connected above the duct 1, and is mounted on a duct connector 43 that surrounds the steering shaft 3. More specifically, the casing 4*b* is attachable to and detachable from the rear of the duct connector 43.

Figure 12:
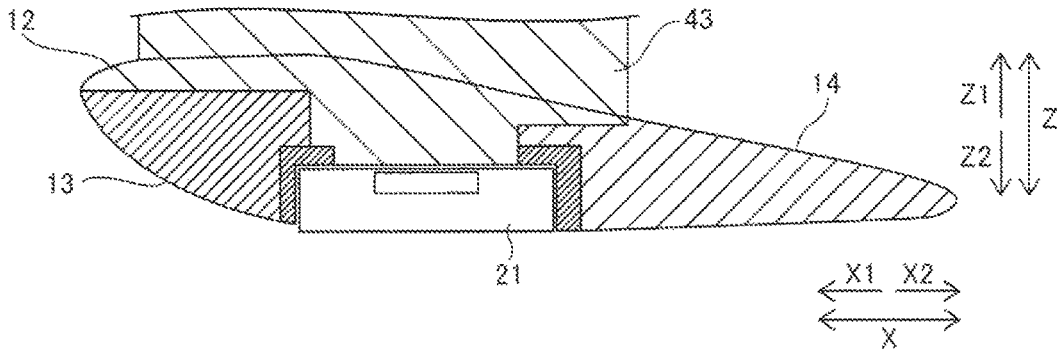
FIG. 12 is a sectional view partially showing a duct of the marine propulsion unit according to the third preferred embodiment of the present invention.

As shown in FIGS. 11 and 12, the duct 1 is able to be divided into a central portion 12, a front portion 13, and a rear portion 14. The stator 11 (see FIG. 10) is disposed in the central portion 12. The central portion 12 is connected to a lower portion of the duct connector 43. The central portion 12 and the duct connector 43 are preferably integral and unitary with each other.

The propeller 2 is mounted on the central portion 12 in a state in which the central portion 12, the front portion 13, and the rear portion 14 are separate from each other. The front portion 13 is connected to a front portion of the central portion 12. Screws or the like provided on the inner periphery of the central portion 12 and screws or the like provided on the outer periphery of the front portion 13 engage with each other such that the front portion 13 is fixed to the central portion 12. The rear portion 14 is connected to a rear portion of the central portion 12. Screws or the like provided on the inner periphery of the central portion 12 and screws or the like provided on the outer periphery of the rear portion 14 engage with each other such that the rear portion 14 is fixed to the central portion 12.

Figure 13:
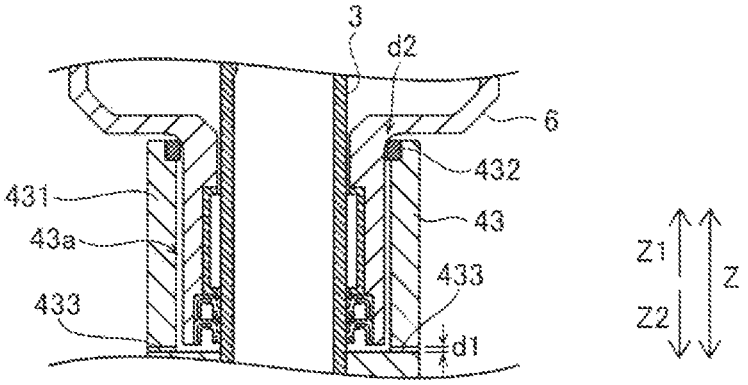
FIG. 13 is a sectional view showing a duct connector of the marine propulsion unit according to the third preferred embodiment of the present invention.
Figure 14:
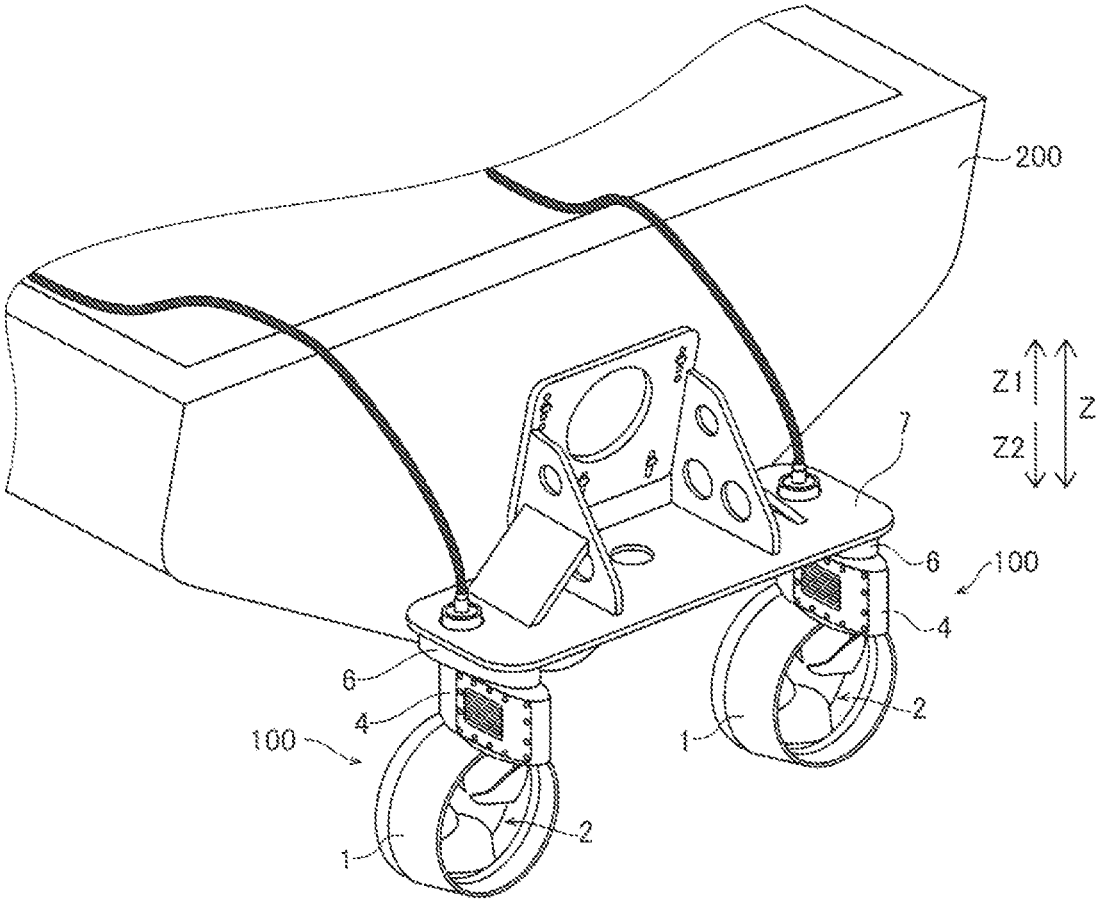
FIG. 14 is a perspective view showing a marine propulsion unit and a bracket according to a modified example of the first preferred embodiment of the present invention.

The duct connector 43 is connected to an upper portion of the duct 1, as shown in FIG. 11. The duct connector 43 surrounds the steering shaft 3. The duct connector 43 includes a housing 431, a collar 432, and through-holes 433. As shown in FIG. 13, the housing 431 includes an internal space 43*a*. The steering shaft 3 is disposed in the internal space 43*a* of the housing 431. More specifically, a lower portion of a housing of the steering mechanism 6 and the steering shaft 3 disposed inside the housing of the steering mechanism 6 are disposed in the internal space 43*a* of the housing 431.

According to the third preferred embodiment, the collar 432 is disposed in the internal space 43*a* between the housing 431 and the steering shaft 3 at the upper end of the housing 431. The collar 432 reduces an opening area that communicates with the internal space 43*a* of the duct connector 43. The collar 432 is disposed between the housing 431 and the housing of the steering mechanism 6. The collar 432 is preferably annular. The collar 432 is preferably made of a resin, for example. The collar 432 is press-fitted such that its outer peripheral portion contacts the housing 431. The radial length d2 of a gap of the inner periphery or the outer periphery of the collar 432 is smaller than the inner diameter d1 of each of the through-holes 433.

The through-holes 433 communicate between the internal space 43*a* in which the steering shaft 3 is disposed and the outside of the duct connector 43. The through-holes 433 are provided below (in a direction Z2) the collar 432. A total of two through-holes 433 are provided, for example, one of which is located on the left side of the duct connector 43 and the other of which is located on the right side of the duct connector 43. The through-holes 433 are provided in the vicinity of the lower end of the internal space 43*a* of the housing 431.

The remaining structures of the third preferred embodiment are similar to those of the first preferred embodiment described above.

According to the third preferred embodiment, the following advantageous effects are achieved.

According to the third preferred embodiment, similarly to the first preferred embodiment described above, the motor controller 5 that controls the rotational driving of the propeller 2 is disposed in the casing 4*b* that is provided separately from the steering shaft 3 and that extends along the rotation axis A of the propeller 2. Accordingly, it is possible to significantly reduce or prevent an increase in the size of the marine propulsion unit while significantly reducing or preventing the complexity of the wiring.

According to the third preferred embodiment described above, the duct connector 43 includes the housing 431 including the internal space 43*a* in which the steering shaft 3 is disposed, the collar 432 which is disposed in the internal space 43*a* between the housing 431 and the steering shaft 3 at the upper end of the housing 431, and the through-holes 433 which are provided below the collar 432 and that communicate between the internal space 43*a* in which the steering shaft 3 is disposed and the outside of the duct connector 43. Accordingly, the collar 432 significantly reduces or prevents entry of foreign matter into the duct connector 43 from the upper surface. Even when foreign matter enters the duct connector 43, the foreign matter is able to be discharged from the through-holes 433 provided there below. Thus, it is possible to significantly reduce or prevent accumulation of foreign matter in the duct connector 43.

According to the third preferred embodiment described above, the radial length d2 of the gap of the inner periphery or the outer periphery of the collar 432 is smaller than the inner diameter d1 of each of the through-holes 433. Accordingly, even when foreign matter enters from the gap of the inner periphery or the outer periphery of the collar 432, the foreign matter is able to be easily discharged from the through-holes 433 each having an inner diameter larger than that of the gap.

The remaining advantageous effects of the third preferred embodiment are similar to those of the first preferred embodiment described above.

The preferred embodiments described above are to be considered as illustrative in all points and not restrictive. The extent of the present invention is not defined by the above description of the preferred embodiments but by the scope of claims, and all modifications (modified examples) within the meaning and range equivalent to the scope of claims are further included.

For example, while the example in which one marine propulsion unit is provided on the marine vessel body has been shown in each of the first to third preferred embodiments described above, the present invention is not restricted to this. According to the present invention, a plurality of marine propulsion units may be provided on the marine vessel body. For example, as in a modified example shown in FIG. 10, two marine propulsion units 100 may be provided on a marine vessel body 200.

While the example in which the casing is elongated so as to extend in an upward-downward direction and a forward-backward direction has been shown in each of the first to third preferred embodiments described above, the present invention is not restricted to this. According to the present invention, the casing may be elongated so as to extend in a right-left direction and the forward-backward direction (horizontal direction). In this case, the casing may function as a cavitation plate that significantly reduces or prevents entrainment of air during the driving of the propeller.

While the example in which the motor controller includes the CPU, the motor driver, and the inverter has been shown in each of the first and second preferred embodiments described above, the present invention is not restricted to this. According to the present invention, the motor controller may include at least one of the motor driver and the inverter.

While the example in which the duct is steered by the steering mechanism has been shown in the first to third preferred embodiments described above, the present invention is not restricted to this. According to the present invention, a tiller handle or the like may be provided to manually steer the duct (marine propulsion unit).

While the example in which the steering mechanism is electrically driven has been shown in each of the first to third preferred embodiments described above, the present invention is not restricted to this. According to the present invention, the steering mechanism may be hydraulically driven.

While the example in which the marine propulsion unit is manipulated based on the operation of the steering wheel and the remote controller has been shown in each of the first to third preferred embodiments described above, the present invention is not restricted to this. According to the present invention, the marine propulsion unit may be manipulated based on the operation of a joystick, for example.

While the example in which the four blades are provided in the propeller has been shown in each of the first to third preferred embodiments described above, the present invention is not restricted to this. According to the present invention, the number of the blades may be three or less, or five or more.

While the example in which no shaft is provided on the rotation axis of the propeller has been shown in each of the first to third preferred embodiments described above, the present invention is not restricted to this. According to the present invention, a shaft connected to the blades may be provided on the rotation axis of the propeller.

While the example in which the motor including the stator and the rotor is a radial gap motor has been shown in each of the first to third preferred embodiments described above, the present invention is not restricted to this. According to the present invention, the motor may be an axial gap motor in which a stator and a rotor face each other along its rotation axis.

While the example in which the motor including the stator and the rotor is a reluctance torque motor has been shown in each of the first to third preferred embodiments described above, the present invention is not restricted to this. According to the present invention, the motor may be a permanent magnet motor in which a plurality of permanent magnets are provided in a rotor.

While the example in which the marine propulsion unit is mounted on the rear of the marine vessel body has been shown in each of the first to third preferred embodiments described above, the present invention is not restricted to this. The marine propulsion unit according to the present invention may be mounted on the front or side of the marine vessel body.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion unit comprising:

a duct including a stator;

a propeller including a rim including a rotor disposed at a position that faces the stator and a blade provided radially inward of the rim;

a steering shaft that supports the duct such that the duct is steerable;

a casing provided separately from the steering shaft and that extends in a direction parallel or substantially parallel to a rotation axis of the propeller; and a motor controller disposed in the casing and configured or programmed to control rotational driving of the propeller; wherein the casing is fixed to the duct so as to be steerable together with the duct.

2. The marine propulsion unit according to claim 1, wherein the casing is integral and unitary with the duct.

3. The marine propulsion unit according to claim 1, wherein the casing is disposed above the duct.

4. The marine propulsion unit according to claim 1, wherein at least a portion of the casing is located rearward of the steering shaft.

5. The marine propulsion unit according to claim 1, wherein at least a portion of the casing extends rearward of a rear end of the duct.

6. The marine propulsion unit according to claim 5, wherein the casing is fixed to the duct behind the duct and on the rotation axis of the propeller.

7. The marine propulsion unit according to claim 1, wherein the casing defines and functions as a skeg.

8. The marine propulsion unit according to claim 1, further comprising a heat radiator exposed to an outside of the casing and adjacent to a region of the casing in which the motor controller is disposed.

9. The marine propulsion unit according to claim 1, wherein the motor controller is provided on a substrate that extends parallel or substantially parallel to the rotation axis of the propeller; and the casing is elongated so as to extend in a direction in which the substrate extends.

10. The marine propulsion unit according to claim 1, wherein the casing is streamlined in the direction parallel or substantially parallel to the rotation axis of the propeller.

11. The marine propulsion unit according to claim 1, wherein the motor controller includes at least one of a motor driver and an inverter.

12. The marine propulsion unit according of claim 1, wherein a sectional shape of the duct varies in the direction parallel or substantially parallel to the rotation axis of the propeller.

13. The marine propulsion unit according of claim 1, wherein the blade includes at least three and not more than eight blades.

14. The marine propulsion unit according to claim 1, further comprising:

a steering mechanism disposed above the duct and that steers the duct; wherein the casing is disposed between the duct and the steering mechanism.

15. The marine propulsion unit according to claim 14, wherein the steering mechanism is streamlined in a forward-backward movement direction.

16. The marine propulsion unit according to claim 14, wherein the steering mechanism includes an electric motor, and rotates the steering shaft by driving the electric motor.

17. The marine propulsion unit according to claim 14, wherein an upper surface of the steering mechanism is fixed to a bracket mounted on a marine vessel body.

18. The marine propulsion unit according to claim 17, wherein the bracket includes a marine vessel body mount and a propulsion unit mount.

19. The marine propulsion unit according to claim 1, further comprising:

a duct connector connected to an upper portion of the duct and that surrounds the steering shaft; wherein the duct connector includes a housing including an internal space in which the steering shaft is disposed, a collar disposed in the internal space between the housing and the steering shaft at an upper end of the housing, and a through-hole below the collar and that communicates between the internal space in which the steering shaft is disposed and an outside of the duct connector.

20. The marine propulsion unit according to claim 19, wherein a radial length of a gap of an inner periphery or an outer periphery of the collar is smaller than an inner diameter of the through-hole.

21. A marine propulsion unit comprising:

a duct including a stator;

a propeller including a rim including a rotor disposed at a position that faces the stator and a blade provided radially inward of the rim;

a steering shaft that supports the duct such that the duct is steerable;

a casing provided separately from the steering shaft and that extends in a direction parallel or substantially parallel to a rotation axis of the propeller; and a motor controller disposed in the casing and configured or programmed to control rotational driving of the propeller; wherein in a planar view, a length of the casing in the direction parallel or substantially parallel to the rotation axis of the propeller is larger than a length of the casing in a direction perpendicular or substantially perpendicular to the rotation axis of the propeller.

* * * * *